US005330063A

United States Patent [19]

Remmers

[11] Patent Number: 5,330,063

[45] Date of Patent: Jul. 19, 1994

[54] ORGANIZER GLIDE SYSTEM

[75] Inventor: Lee E. Remmers, Ocala, Fla.

[73] Assignee: Vermont American Corporation, Louisville, Ky.

[21] Appl. No.: 892,284

[22] Filed: Jun. 2, 1992

[51] Int. Cl.[5] ..... A47F 5/00

[52] U.S. Cl. ..... 211/162; 211/126

[58] Field of Search ..... 211/162, 94.5, 194, 211/181, 51, 59.3, 43, 126; 312/331, 332, 333, 348.1, 349

[56] References Cited

U.S. PATENT DOCUMENTS

| | | | |
|---|---|---|---|
| 596,153 | 12/1897 | Gerbereux | 211/181 X |
| 735,716 | 8/1903 | Dahlquist | 312/349 |
| 2,194,177 | 3/1940 | Rundell | 312/350 |
| 2,367,218 | 1/1945 | Joyce, Jr. . | |
| 2,671,004 | 3/1954 | Chadwick et al. | 312/350 |
| 2,946,458 | 7/1960 | Du Boff et al. . | |
| 2,971,655 | 2/1961 | Duboff et al. . | |
| 3,082,879 | 3/1963 | Wilson . | |
| 3,114,459 | 12/1963 | Kersting . | |
| 3,159,280 | 12/1964 | Condon | 211/162 X |
| 3,220,364 | 11/1965 | Sandin | 211/162 X |
| 3,241,683 | 3/1966 | Blodee | 211/43 |
| 3,346,318 | 10/1987 | Propst | 312/348.1 |
| 3,399,784 | 9/1968 | Buchbinder et al. | 211/162 X |
| 3,465,763 | 9/1969 | Hoffman | 211/162 X |
| 3,592,521 | 7/1971 | Cox | 312/333 |
| 3,848,748 | 11/1974 | Ceccarelli | 211/181 X |
| 3,999,734 | 12/1976 | Gibson et al. | 211/43 X |
| 4,023,682 | 5/1977 | Niece | 211/43 X |
| 4,025,013 | 5/1977 | Anantharaman . | |
| 4,782,960 | 11/1988 | Mavrakis | 211/43 X |
| 4,913,298 | 4/1990 | Compagnucci . | |
| 4,982,851 | 1/1991 | Konstant | 211/162 X |
| 5,103,799 | 4/1992 | Atanasio | 211/181 |
| 5,111,940 | 5/1992 | VanNoord | 211/162 X |
| 5,181,621 | 1/1993 | Plaehn | 211/181 |

*Primary Examiner*—David A. Scherbel
*Assistant Examiner*—Korie Chan
*Attorney, Agent, or Firm*—Middleton & Reutlinger

[57] ABSTRACT

The organizer glide system of the present invention is comprised of a base frame slidably engaging a pair of support rails mounted to a support surface. A wire basket or other organizer container is removably secured to the base frame. The glide system is designed so that the application of external pressure, such as is generated by a heavy object held within the organizer, creates tension on the leg members of the base frame; thereby flexing the leg members resulting in a trussing effect by the side runners against the channel walls to control the sliding movement of the base frame and container. Interaction of the stop member of the base frame with the stops of the support rails limits the reciprocating movement of the glide system.

10 Claims, 6 Drawing Sheets

ORGANIZER GLIDE SYSTEM

BACKGROUND OF THE INVENTION

The present invention relates to a reciprocating organizer glide system having a base frame slidably engaging a pair of support rails mounted to a generally flat support surface. A wire basket or other organizer is removably secured to the base frame. The glide system is designed so that flexing the leg members of the base frame creates a trussing effect between the base frame side runners and the channels of the support rails to control the sliding movement and reciprocation of the base frame and organizer within the support rails.

Conventional cabinets have relatively long shelves and/or drawers to hold objects for storage. Items placed at the back of the shelf or drawer are often difficult to reach. Sometimes items on the shelf must be removed to reach a particular item, or a drawer must be removed in order to remove the item. The reciprocating organizer glide system of the present invention provides a means to move containers or other such organizers closer to the user with a minimum of effort, and to hold the organizer at a desired location without the user having to engage any type of stop or latch means.

The shelving industry has for many years attempted to provide a solution to provide easier access for the user to hard to reach storage areas. For instance, U.S. Pat. No. 2,946,458 shows a typical reciprocating tray unit having a wire basket mounted on loops which pass over and around the rails of a base to reciprocate thereon. U.S. Pat. No. 2,367,218 shows a wire basket frame adapted to rest in and slide along open ended L-shaped "angle iron" tracks. Furthermore, U.S. Pat. No. 2,971,655 shows a conventional reciprocating tray formed of wire and adapted to slide in a guide via rollers. Yet another invention, U.S. Pat. No. 4,025,013 shows a support platform for a wire dish drainer having an extension leg member. However, none of these inventions incorporate the features of the organizer glide system of the instant invention to provide a simple means of controlled reciprocation of an organizer within a base.

Accordingly, it is an object of the present invention to provide a reciprocating organizer glide system which eliminates rolling parts such as wheels and does not require additional mechanical assemblies such as bearings.

It is another object of the present invention to provide a glide system having built in stop means which work in conjunction with stop means on the base frame to limit the movement of an organizer in the pulled-out open position, and in the pushed-in closed position.

It is yet another object of the reciprocating organizer glide system to design the glide system whereby the stop means permit the removal of the organizer units by simply lifting the organizer container upward and pulling the organizer forward toward the user. Furthermore, the glide system is designed so that the organizer units may installed within the glide system by simply inserting the leg members of the base frame within the glide system runners.

It is yet another object of the present invention to provide a base frame and support runners which can be manufactured from either metal or plastic and adapted for installation utilizing a base frame having either round or square tubing.

It is still another object of the present invention to provide a glide system having a low profile in order to maximize usable space above the base frame, and provide a decorative appearance.

A further object of the present invention is to utilize support rails for the glide system which are symmetrical, having no left and right hand sides or front and back sides, in order to simplify installation of the runners within a drawer or upon some other flat surface by merely aligning the runners parallel to one another, and spaced the proper distance apart from one another.

Most important, the reciprocating organizer glide system of the present invention utilizes a novel means to control the sliding movement of the base frame holding the organizer within the support rails in order to create a trussing effect, so that the more downward weight is applied to the base frame, the more the base frame flexes within the support rails to control the sliding reciprocating movement and hold the organizer and base frame within the support rails.

SUMMARY OF THE INVENTION

The present invention is a reciprocating organizer glide system comprising a base frame, an organizer container mounted onto the base frame, and a pair of support rails to slidably hold the base frame and organizer.

The base frame has a plurality of rod members including a pair of spaced apart, parallel front and rear cross members, a pair of leg members extending downward at an angle from the distal ends of each one of the cross members, and a pair of side runners spaced apart and extending longitudinally and parallel to one another, generally perpendicular to the cross members, and attached to the distal ends of the leg members. A pair of spaced apart, parallel, support members extend lengthwise, parallel to, and in between the side runners. The support members are attached perpendicular to and near the distal ends of the cross members. Furthermore, a stop member is attached between the front and rear cross members perpendicular to and across the bottom of each of the support members at one end. The distal ends of the stop member extends outward at least as far as the side runners.

The support rails are mounted to a support structure such as a flat surface and spaced apart parallel to one another. Each one of the support rails are molded having an inner channel within the interior wall extending continuously along the entire length of the support rail adapted to accommodate the side runners of the base frame, so that the side runners are slidably engaged within the channels of the support rails. A plurality of spaced apart grooves extend longitudinally within the exterior wall of each of the support rails. In the preferred embodiment of the present invention, each of the support rails have a front and rear wedge stop located on the top surface near each end of the support rails.

To use the glide system, the base frame is slidably held within the channels of the support rails. A wire basket or other organizer container is removably secured to the base frame. The glide system is designed so that the runners of the base frame slide within the channels of the support rails. Application of external pressure, such as generated by the user or a heavy object held within the organizer, creates tension on the leg members of the base frame; thereby resulting in a trussing effect by the side runners against the channel walls to control the sliding movement of the base frame and container. Interaction of the stop member of the base frame with the front or rear wedge stops of the support rails limits the reciprocating movement of the glide system.

BRIEF DESCRIPTION OF THE DRAWINGS

A better understanding of the present invention will be had upon reference to the following description in conjunction with the accompanying drawings in which like numerals refer to like parts throughout the several views and wherein.

The reciprocating organizer glide system of the present invention is comprised of a glide system 10 including a base frame 12 slidably engaging a pair of longitudinal members or side support rails 14. A wire basket organizer 16 is removably attached to the base frame 12 as shown in FIG. 1.

The organizer "container" 16 can be fabricated from wood, cardboard, plastic, metal, or plastic coated metal and can be formed having a solid bottom and/or solid walls. As shown in FIG. 1, the organizer 16 is formed from steel wire and rods crisscrossing to form a wire mesh container.

Figure 1:
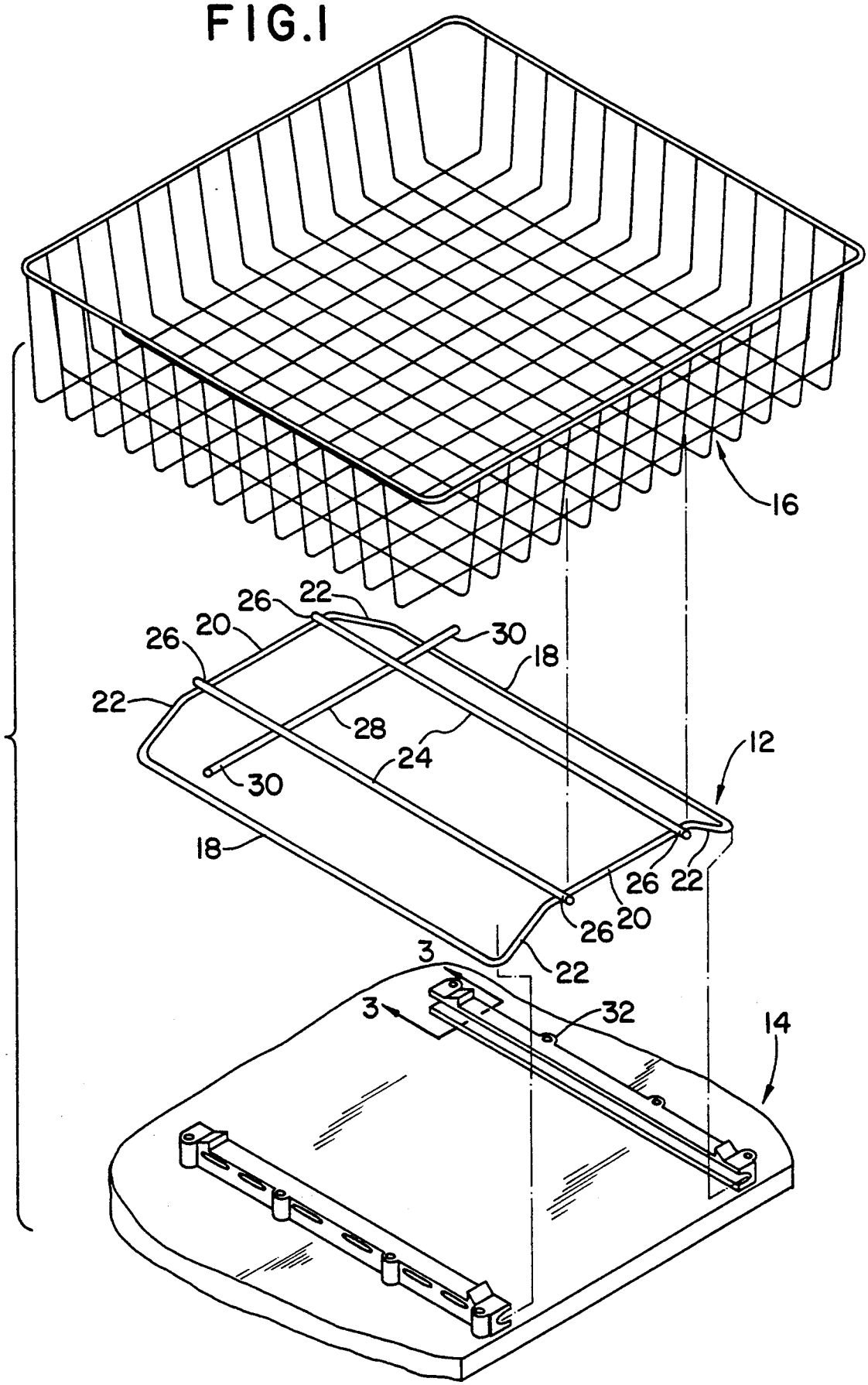
FIG. 1 is a perspective exploded view of the reciprocating organizer glide system of the present invention showing a wire basket organizer elevated above the base frame, wherein the base frame is elevated above the support rails which are mounted to a flat surface.

The preferred embodiment of the base frame 12 of the glide system 10 as shown in FIG. 1 is comprised of a plurality of rod members, wherein one of the rods is bent inwardly at four generally 90 degree angles so that the distal ends of the rods meet. The rod ends are welded together to form a continuous, generally rectangular shaped loop. It is not necessary that the rod members form a continuous rectangular shaped loop, for a plurality of individual longitudinal members could be joined to form a base frame 12. The rod members forming the lengthwise sections of the loop define a pair of side runners 18, spaced apart, parallel from one another. The end sections of the loop connecting the runners 18 together are formed by the pair of spaced apart, parallel front and rear cross members 20. Each cross member 20 is bent downward at an angle forming a pair of leg members 22 on the distal ends of each of the cross members 20 joining the side runners 18. The leg members 22 can be formed of independent segments joined to the cross members 20 as well. It is contemplated that the cross members 20 and leg members 22 can be formed in various sizes and shapes to support various types of organizers 16; however the leg member(s) 20 must provide flexible support between the cross member(s) 20 and the side runners 18.

Attached perpendicular to the cross members 20 near the junction with the leg members 22, are a pair of spaced apart, parallel, organizer support members 24, shown in the preferred embodiment as support "rod members" extending lengthwise, parallel to, and in between the side runners 18 to provide structural support for the bottom of the organizer 16. In the preferred embodiment as shown in FIG. 1, the distal ends 26 of the support members 24 extend outward pass the front and rear cross members 20 to accommodate the dimensions of the organizer 16; however, it is only necessary that the support members extend far enough to join the cross members. It is contemplated that a plurality of support members 24 could be used to support heavy organizers, or that only one support member 24 would be necessary for lightly loaded organizers.

Figure 13:
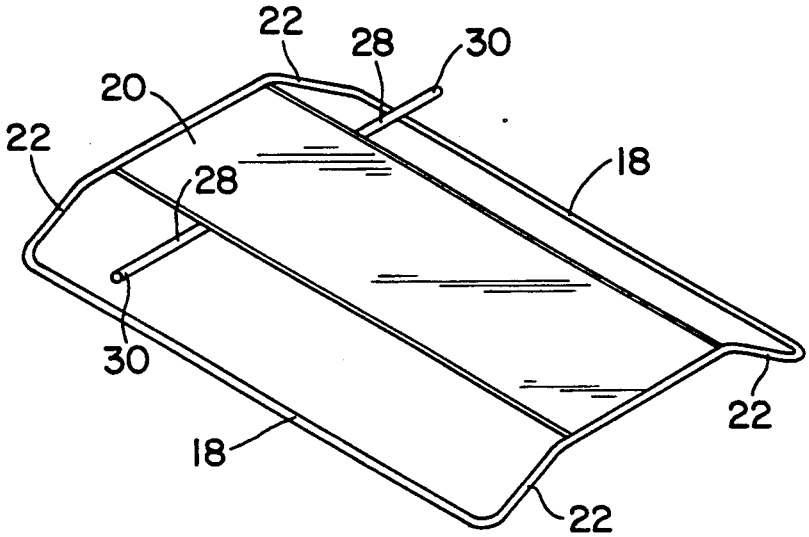
FIG. 13 is a perspective view of an alternate embodiment of the base frame of the present invention having a unitary cross member joined to the side runners by angled leg members.
Figure 14:
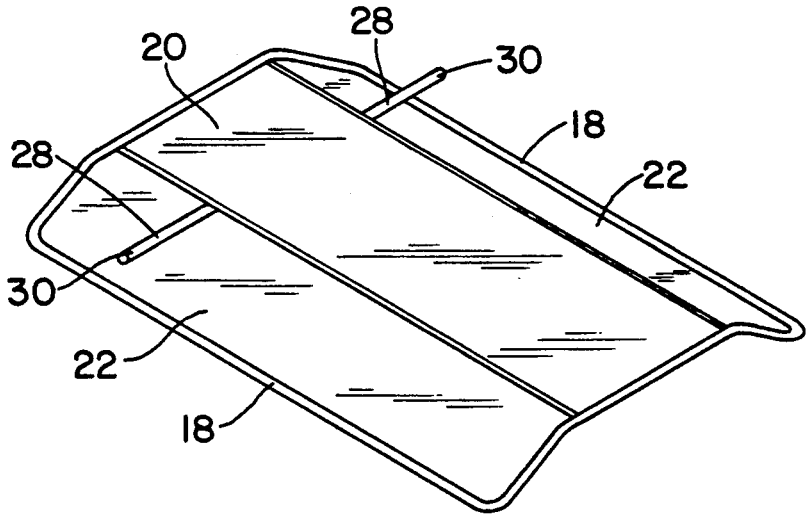
FIG. 14 is perspective view of another embodiment of the base frame of the present invention having a cross member and leg members are formed from a single piece of material.

The glide system 10 could be utilized without any support members 24 at all for particular applications by increasing the strength of the cross members 20 and leg members 22 and providing a stop means which extends outward from the cross members 20. For instance, FIG. 13 shows the base frame 12 of the present invention formed having a single cross member 20 defining a panel to support the organizer 16. The leg members 22 extend from the cross member 20 downward at an angle providing a flexible support means joining the side runners 18. Furthermore, it is contemplated that the base frame 12 could be formed, "molded" from a single piece of plastic material to provide a generally solid cross member 20 having leg "panel" members 22 extending downward from the cross member joining the side runners 18 as shown in FIG. 14. The single cross member 20 or leg "panel" members 22 shown in FIGS. 13 and 14 need not be solid and may have various sized spaces or holes therein to provide attachment means for particular sized or shaped organizers 16.

Figure 2:
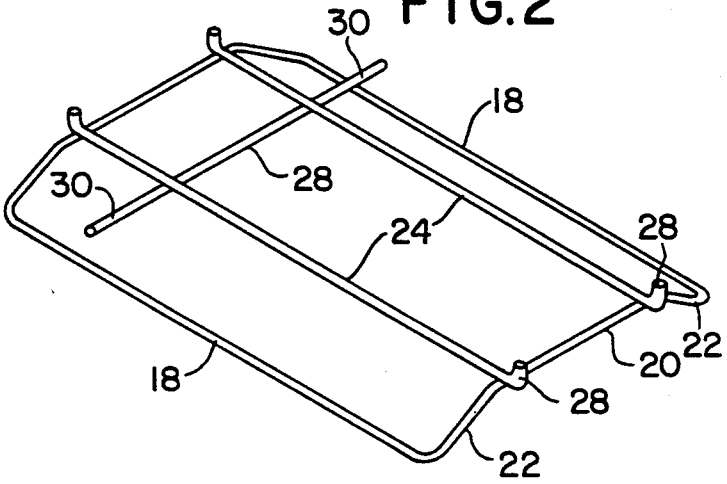
FIG. 2 is a perspective view of an alternate embodiment of the base frame of the present invention, showing the distal ends of the cross members of the base frame being bent at an angle to project upward providing an attachment means which may be used to removably attach an organizer such as a wire basket to the base frame.

As shown in FIGS. 1 and 2, at least one stop means, such as stop member 28, shown in the preferred embodiment as a "rod member" is attached between the front and rear cross members 20, perpendicular to, and across the bottom of both of the support members 26. FIG. 1 shows that the distal ends 30 of the stop members extend outward at least as far as the side runners 18 in order to contact the stop means of the support rails 14 and rest upon the top surface of the support rails 14 in the pulled-out open position. The stop member 28 is positioned near the rear cross member 20 in order to limit the inward and outward movement of the wire basket organizer 16 during use.

Figure 9:
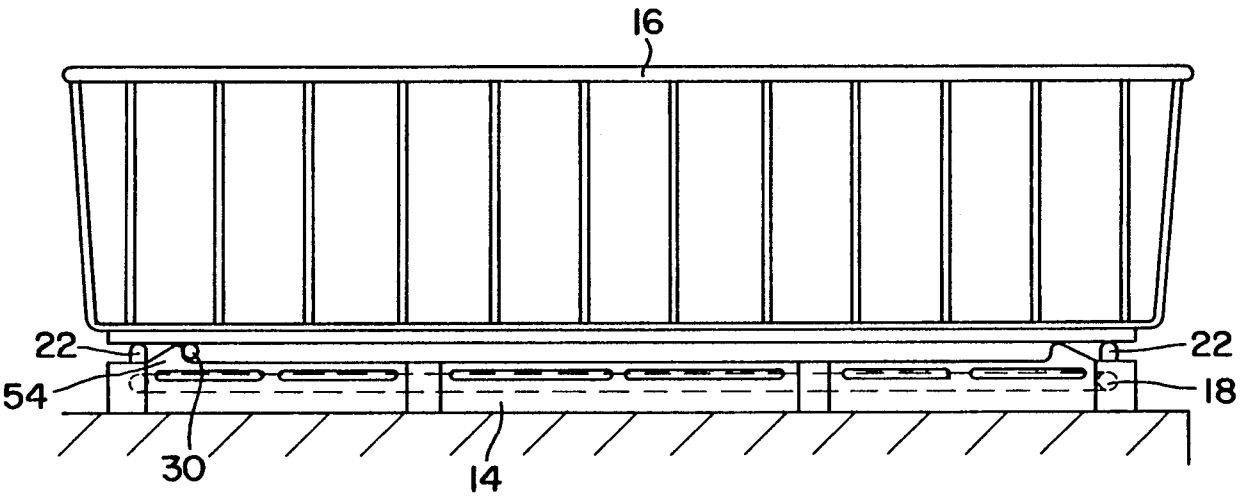
FIG. 9 is a side view of the invention shown in FIG. 1, showing the wire basket mounted on the base frame wherein the side runners, shown in phantom view, are slidably mounted within the channels of the support rails in the pushed-in closed position.
Figure 11:
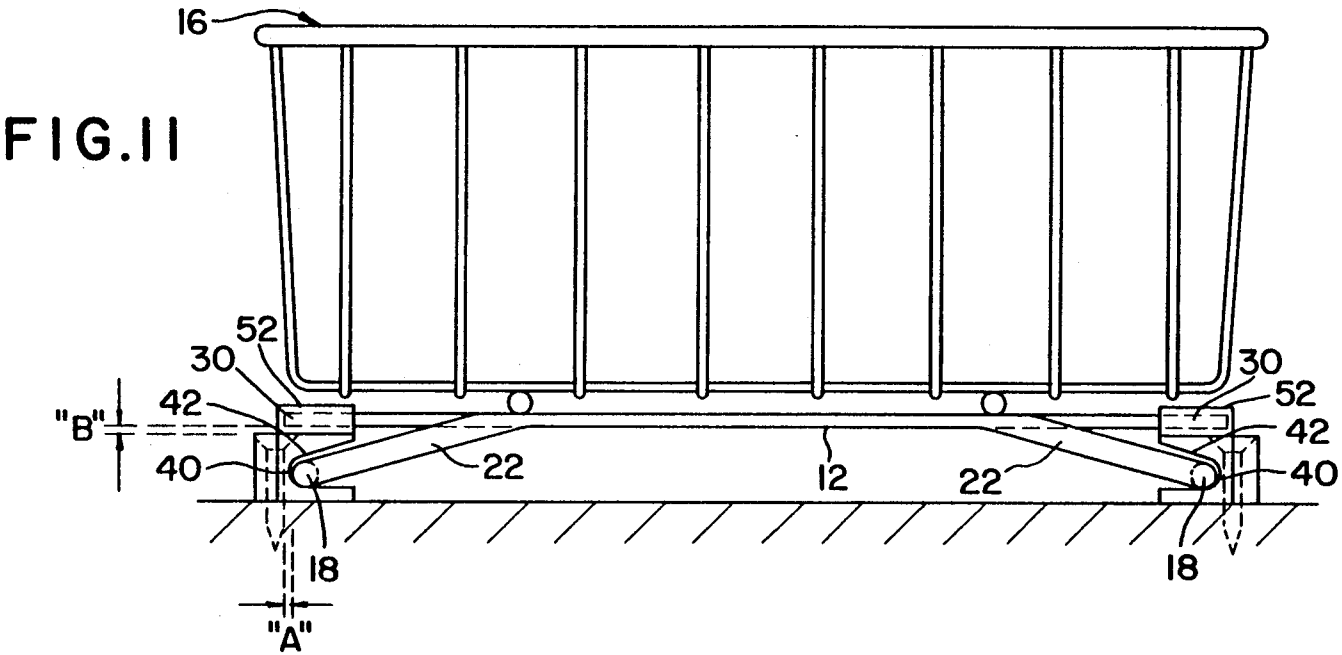
FIG. 11 is an end view of the present invention, showing the wire basket organizer and base frame slidably mounted within the support rails in the pushed-in closed position, and the base frame stop member means and screws for mounting the support rails to the flat surface are shown in phantom view behind the wedge stop means of the support rails.

The base frame 12 is attached to the bottom of the wire basket organizer 16 as shown in the preferred embodiments in FIGS. 9 and 11. An alternative embodiment of the base frame 12 is shown in FIG. 2, wherein the protruding distal ends 26 of the support members 24 are bent at an angle of approximately 90 degrees to project upward providing an attachment means which may be used to removably attach an organizer 16 such as a wire basket to the support members 24 of the base frame 12.

Figure 5:
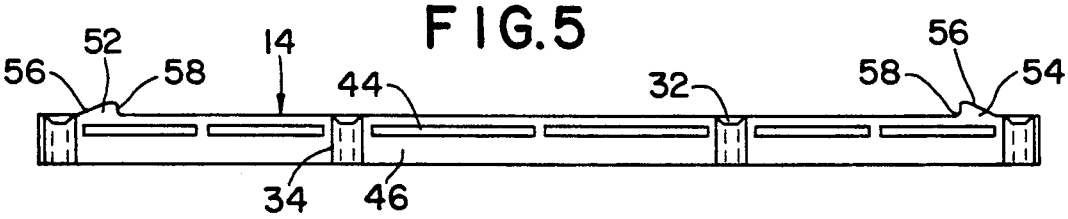
FIG. 5 is a side view of the exterior groove, wedge stop means, and screw sockets of the support rail of FIG. 1 showing the screws in phantom view.
Figure 6:
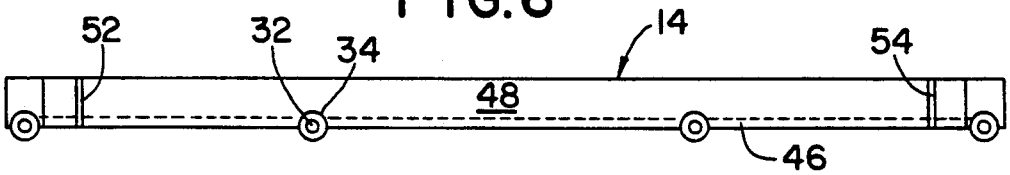
FIG. 6 is a top view of the support rail of FIG. 1 showing the depth the channel extends into the interior sidewall of the side support rail.

The support rails 14 of the glide system 10 are spaced apart and parallel to one another as shown in FIG. 1. The support rails 14 are simply mounted to any type of flat surface or support structure with bolts or screws 32 which fit into a plurality of sockets 34 extending vertically through the top rail surface 48 of the support rail 14. The sockets 34 are formed "molded" into the support rails 14 at the time of manufacture as shown in FIGS. 5 and 6. The sockets 34 extend outward pass the exterior sidewall 46 of the support rails 14, as shown in FIG. 6, in order to decrease the amount of material used to mold the support rails 14. However, the support rails 14 can be molded so that the exterior sidewall 46 extends flush with the sockets 34, then the socket holes 24 can be drilled into the support rails 14 after the molding process to accommodate the screws 32. Other types of holding means such as clamps, velcro, or glue could also be utilized to mount the support rails 14 to a support surface.

Figure 3:
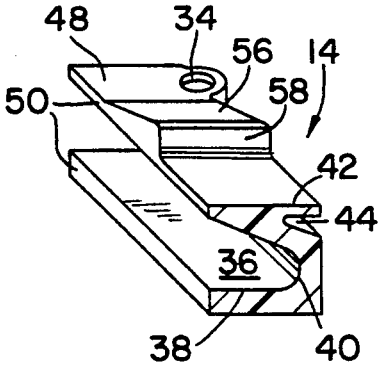
FIG. 3 is a prospective cross-sectional view along line Section 3—3 of FIG. 1 showing the inner side channel, outer side groove, and wedge stop means on the top surface of the support rail.
Figure 4:
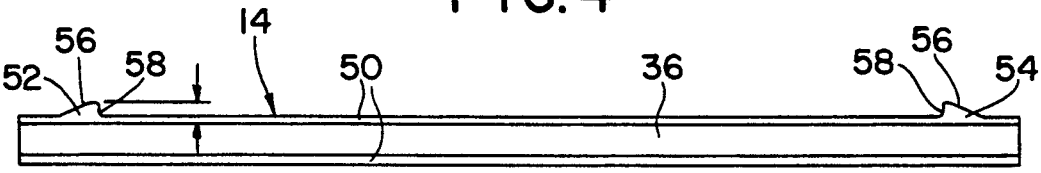
FIG. 4 is a side view of the interior rail channel and stop wedge means of the support rail of FIG. 1.

FIGS. 1, 4, 6, and 8 show that each one of the support rails 14 is formed having an inner channel 36 extending into the interior sidewall 50 of the support rail 14 as shown in FIG. 3, which is a cross-sectional view of FIG. 1 taken along Section 3—3, and in phantom view in FIG. 6. The channels 36 extend continuously along the entire length of the support rails 14 and are adapted to accommodate the frame side runners 18 of the base frame assembly 12 which are slidably engaged within the support rails 14. The inner channels 36 are sized to provide a complimentary slip fit with the frame side runners 18. As shown best in FIG. 3, each of the channels 36 are formed having a flattened parabolic cross-sectional shape. More particularly, the flattened parabolic cross-sectional shape of channel 36 is defined having a generally flat bottom channel surface 38, a curved generally parabolic shaped side channel surface 40 and sloped top channel surface 42. The shape of the channel 36 is an important feature of the present invention not incorporated in prior art devices, for the shape of the channel 36 is designed to be complementary to the shape of the frame side runner 18 to provide a support and guide means to accommodate the flexing of the side runners 18 within the channels 36 of the support rails 14 during use.

Figure 8:
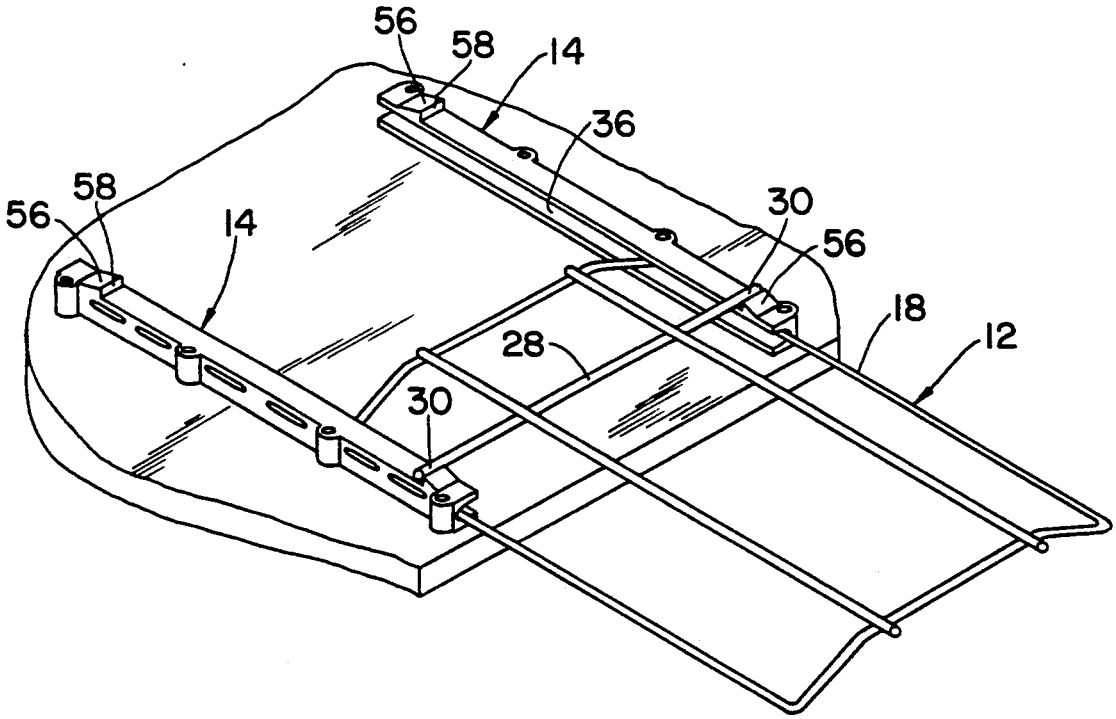
FIG. 8 is a perspective view of the present invention showing the base frame in the pulled-out open position slidably mounted within the channels of the support rails, whereby the stop member means of the base frame rests against the support rail front wedge stops and limits the forward movement of the base frame within the support rails.

Furthermore, as shown in FIGS. 1, 5, and 8, the support rails 14 of the preferred embodiment are formed having a plurality of spaced apart external grooves 44 extending longitudinally between the sockets 34 through the exterior rail sidewall 46 of the support rails 14. The external grooves 44 are molded into the support rails 14 to prevent deformation of the plastic during the molding operation for larger, thick support rails 14, to save material, to reduce costs, and to provide a decorative effect to enhance the appearance of the glide system 10.

The thickness of both the support rails 14 and the base frame members 12 of the glide system 10 are determined according of the size and weight of the contents for which the organizer 16 is designed.

As shown in FIGS. 1, and 3–12, each one of the support rails 14 have at least one front or rear stop. The preferred embodiment of the present invention incorporates a pair of support rails 14, each having a front wedge stop 52 and rear wedge stop 54. The front and rear stops, 52 and 54, respectively, of each of the support rails 14 are aligned with one another. The front wedge stop 52 and rear wedge stop 54 are integrally molded into the top rail surface 48 near the distal ends of each of the support rails 14 as illustrated in FIG. 3. Each of the wedge stops 52 and 54, respectively, are formed having a top planar guide surface 56 sloping upward and extending inward toward the center of the rail 14. The rear portion of each of the wedge stops 52 and 54 define a wedge abutment wall 58. It is contemplated that other stop means could also be used which form a generally smooth angled outer surface.

Figure 7:
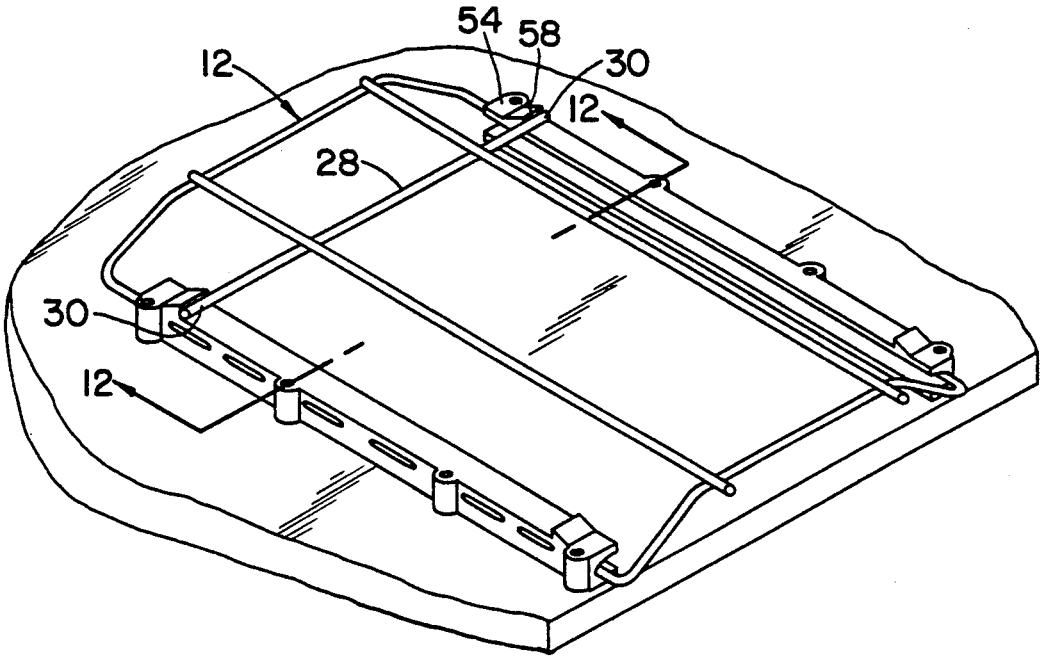
FIG. 7 is a perspective view of the present invention showing the base frame in the pushed-in closed position slidably mounted within the channels of the support rails, whereby the stop member means of the base frame is resting against the rear wedge stops of the support rails to limit the rearward movement of the base frame within the support rails.

The top planar guide surface 56 facilitates assembly of the base frame 12 within the support rails 14. Assembly of the glide system 10 requires that the side runners 18 be slidably inserted into the rail channels 36. After the ends of the base frame 12 have been started within the rail channels 36, slight pressure must be exerted upon the base frame 12 along the longitudinal axis in order to force distal ends 30 of the stop member 28 up and over the top planar guide surfaces 56 of the front wedges 52. The wedge or a generally rounded shape on the outer side of the stop means permits sliding of the stop member 28 and base frame into position. As best shown in FIGS. 2, 7, and 8, the stop member 28 is spaced apart from the side runners 18 a selected distance to accommodate insertion of the side runners 18 into the rail channels 36. Upon assembly, the side runners 18 are spaced slightly above the top rail surface 48, and the stop member 28 of the base frame 12 is positioned between the front and rear wedge stops 52 and 54, respectively.

Interaction of the stop member 28 of the base frame 12 with the front or rear wedge stops, 52 and 54 respectively, of the support rails limits the reciprocating movement of the glide system. The wedge abutment wall 58 engages the distal ends 30 of the stop member 28 and limits the sliding movement of the base frame 12 to prevent the organizer 16 from sliding pass the ends of the support rails 14 during reciprocation of the organizer 16 and base frame 12 in either the pulled-out or pushed-in position. As shown in FIG. 7, the stop member 28 is in contact with the wedge abutment wall 58 of the rear wedge stops 54 with the base frame 12 being held in the closed push-in position. FIG. 8 shows the distal ends 30 of the stop member 28 engaging the wedge abutment wall 58 of the front wedge stops 52 with the base frame 12 in the open pulled-out position. The built in front wedge stop 52 and rear wedge stop 54 are also designed to facilitate the removal of the organizer 16 and base frame 12 by lifting the base frame upward and pulling it forward over the front wedge stops 52.

Figure 10:
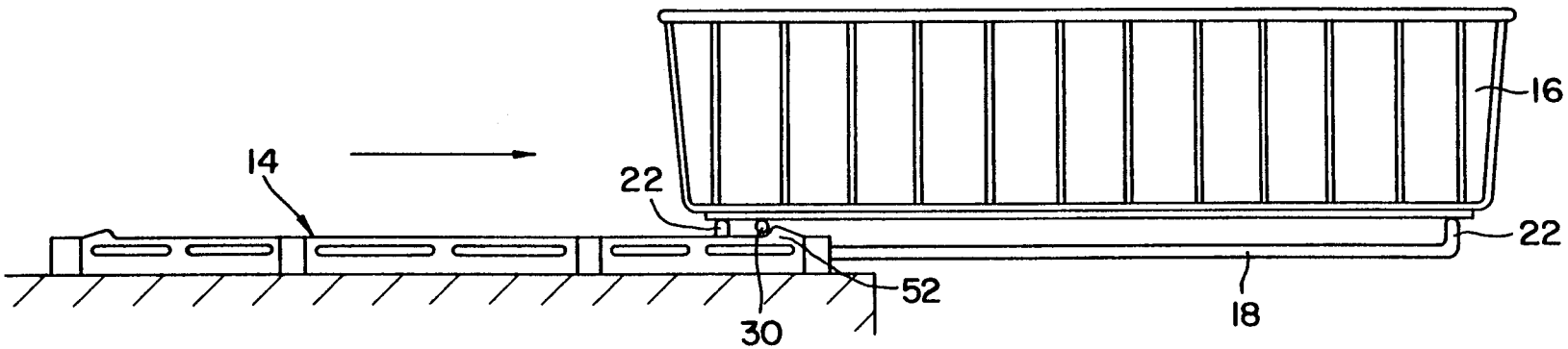
FIG. 10 is a side view of the present invention shown in FIG. 1, showing the wire basket organizer secured to the base frame and the side runners slidably mounted within the channels of the support rails in the pulled-out open position.

A side view of the glide system 10 is shown in FIG. 9 illustrating how the organizer "wire basket" 16 and the side runners 18 (in phantom view) of the base frame 12 are slidably mounted within the channels 36 of the support rails 14 in the pushed-in, closed position. FIG. 10 is shows the organizer 16 secured to the base frame 12 and the side runners 18 being slidably mounted within the channels 36 of the support rails 14 in the pulled-out open position.

Figure 12:
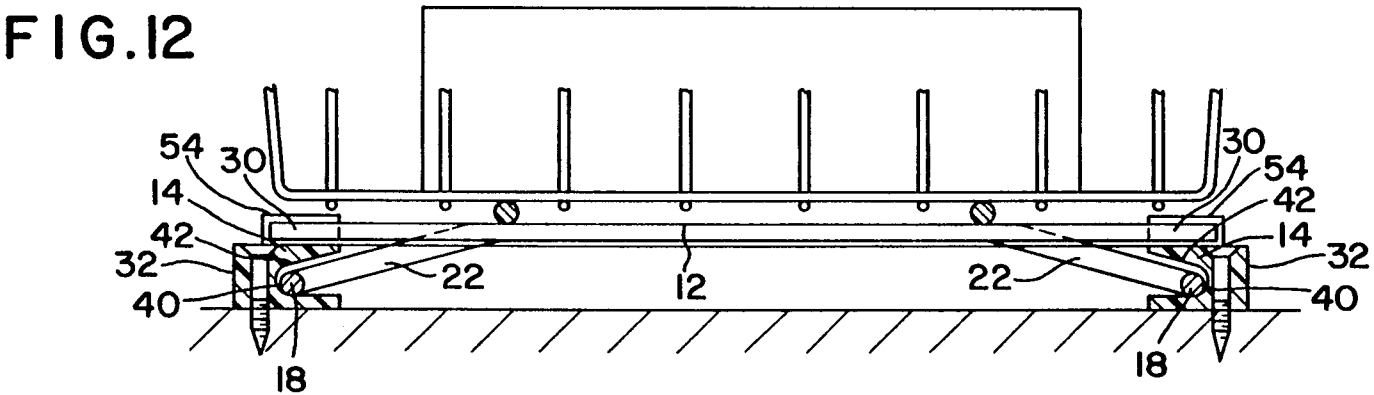
FIG. 12 is a cross-sectional end view of the glide system of the present invention showing the base frame 12 and support rails (including the organizer) taken along Section 12—12 of FIG. 7, after the base frame has been slidably mounted within the support rail channels, and showing the rear wedge stops of the support rails being located behind the stop member of the base frame.

The glide system 10 is designed so that application of external pressure, such as generated by the user or a heavy object held within the organizer, creates tension on the leg members 22 of the base frame 12; thereby, resulting in a trussing effect forcing the side runners 18 against the channel walls of the support rails 14 to inhibit and control the sliding movement of the base frame 12 and organizer container 16 within the support rails 14. More particularly, the trussing effect results from flexing of the leg members 22 and side runners 18 of the base frame 12 against the parabolic shaped side channel surface 40 and the sloped top channel surface 42 as best shown in FIGS. 11 and 12. The amount of flexing of the leg members 22 is dependent upon the amount of force exerted on the organizer 16 and base frame 12. Increasing the downward pressure flexes the leg members 22 more to create more friction within the channels 36 of the support rails 14. The trussing effect provides a means to control the speed and extent of reciprocation of the organizer 16 and sliding base frame 12 within the support rails 14, and prevents the base frame 12 and organizer 16 assembly from jumping out of the channel 36 or "track".

FIG. 11 shows an end view of the glide system 10 having an empty organizer 16 mounted on the base frame 12, wherein the side runners 18 are slidably engaged within the channels 36 of the support rails 14 in the pushed-in, closed position. The distal ends 30 of the stop member 28 and the screws 32 for mounting the support rails 14 to the flat surface are shown in phantom view behind the front wedge stops 52 of the support rails 14. FIG. 11 shows the space "A" between the side rails 18 of the base frame 12, and the parabolic shaped side channel surface 40 and the sloped top channel surface 42 of the side rail support channel 36 when the organizer 16 is empty and no external pressure is exerted against the base frame 12 to flex the leg members 22 and produce a trussing effect. When the organizer 16 is empty and/or not under external pressure, the stop member 28 is spaced apart a distance "B" from the top support rail surface 48 to prevent interference of the sliding movement of the base frame 12 within the support rails 14.

FIG. 12 is a cross-sectional end view of the glide system 10 showing the base frame 12 and support rails 14 (including the organizer 16) taken along Section 12—12 of FIG. 7, after the organizer 16 and base frame 12 have been slidably mounted within the support rail channels 36. The distal ends 30 of the stop member 28 and the screws 32 for mounting the support rails 14 to the flat surface are shown in front of rear wedge stops 54 of the support rails 14. FIG. 12 shows the lack of space "A" between the side rails 18 of the base frame 12, and the parabolic shaped side channel surface 40 and the sloped top channel surface 42 of the side rail support channel 36 when the organizer 16 contains a heavy object 60 which exerts pressure against the base frame 12 to flex the leg members 22 and produce a trussing effect.

Furthermore, as shown in FIG. 12, a heavy object contained within the organizer 16, creates external pressure forcing the stop member 28 downward eliminating the spaced distance "B" between the top support rail surface 48 and the stop member 28 of the base frame 12. This action creates addition friction between the stop member 28 and support rail surface 48 to provide additional control of the sliding movement during reciprocation of the base frame 12 within the support rails 14. As shown in FIG. 8, extension of the base frame 12 outward toward the pulled-out open position also results in contact between the stop member 28 and the support rail top surface 48, whereby the stop member 28 provides additional support for the base frame 12, organizer 16, and organizer contents 60 in the pulled-out position, and provides a means of control of the sliding movement during reciprocation of the empty organizer 16 and base frame 12 within the support rails 14.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims.

I claim:

1. A reciprocating organizer glide system comprising:

a base frame comprising a pair of spaced apart parallel front and rear cross members, a pair of leg members extending downward at an angle from the distal ends of each one of said cross members providing flexible support, a pair of side runners spaced apart extending longitudinally and parallel to one another and generally perpendicular to said cross members and said leg members, said side runners being attached to the distal ends of said leg members, a pair of spaced apart and parallel support members extending lengthwise, parallel to, and in between said side runners being attached to said cross members and a stop member attached to said support members between said front and rear cross members, located near one end of said support members, said stop member extending outward at least as far as said side runner; and a pair of support rails mounted to a support structure, spaced apart and parallel to one another, each one of said support rails comprising a top surface, an exterior sidewall, and an interior sidewall, an inner channel within said interior sidewall extending continuously along the entire length of said support rail for supporting said side runners of said base frame, said side runners being slidably engaged within said channels of said support rails, a plurality of spaced apart external grooves extending longitudinally within said exterior sidewall of each of said support rails, and a front or rear stop means located on said top surface near one end of each of said support rails.

2. The reciprocating organizer glide system of claim 1, wherein the front stop and rear stop of said support rails are defined by a wedge integrally molded into said top surface near the distal ends of each of said support rails.

3. The reciprocating organizer glide system of claim 2, wherein said wedge stops of said support rails are formed having a top planar guide surface sloping upward and extending inward toward the center of said support rail, and a rear portion forming an abutment wall.

4. The reciprocating organizer glide system of claim 1, wherein said channels of said support rails are formed having a flattened parabolic cross-sectional shape defined by a generally flat bottom channel surface, a curved generally parabolic shaped side channel surface and a sloped top channel surface.

5. The reciprocating organizer glide system of claim 1, wherein each one of said support rails are formed having at least one screw socket having a hole therein extending vertically through said top support rail surface.

6. The reciprocating organizer glide system of claim 5, wherein said screw socket is formed within said support rail extending outward from said exterior sidewall of said support rail.

7. The reciprocating organizer glide system of claim 1, wherein said leg members of said cross members are joined together with the distal ends of said side runners of said base frame forming a continuous, generally rectangular shaped loop.

8. The reciprocating organizer glide system of claim 1, wherein the distal ends of said support members extend outward pass said front and rear cross members of said base frame.

9. The reciprocating organizer glide system of claim 1, wherein said support members are formed having the distal ends bent at an angle projecting upward providing an attachment means which may be used to removably attach an organizer such as a wire basket to said support members of said base frame.

10. The reciprocating organizer glide system of claim 1, wherein said base frame and said support rails are comprised of materials selected from the group consisting of wood, plastic, metal, plastic coated metal, or combinations thereof.

* * * * *